US009970160B2

(12) United States Patent
Habel et al.

(10) Patent No.: US 9,970,160 B2
(45) **Date of Patent: *May 15, 2018**

(54) RAIL GAUGE-PLATE INSULATOR

(71) Applicant: Tom Habel, Marco Island, FL (US)

(72) Inventors: Tom Habel, Marco Island, FL (US); David J. Lawrence, Greer, SC (US); Ernest J. Allison, Hartwell, GA (US)

(73) Assignee: Tom Habel, Marco Island, FL (US)

( * ) Notice: Subject to any disclaimer, the term of this patent is extended or adjusted under 35 U.S.C. 154(b) by 71 days.

This patent is subject to a terminal disclaimer.

(21) Appl. No.: 14/966,150

(22) Filed: Dec. 11, 2015

(65) Prior Publication Data

US 2016/0097166 A1 Apr. 7, 2016

Related U.S. Application Data

(63) Continuation of application No. 13/783,735, filed on Mar. 4, 2013, now Pat. No. 9,234,314.

(60) Provisional application No. 61/609,577, filed on Mar. 12, 2012.

(51) Int. Cl.
*E01B 9/68* (2006.01)
*E01B 5/16* (2006.01)

(52) U.S. Cl.
CPC ..... *E01B 9/68* (2013.01); *E01B 5/16* (2013.01); *E01B 9/685* (2013.01)

(58) Field of Classification Search
CPC ... E01B 9/68; E01B 9/685; E01B 5/16; E01B 11/54
See application file for complete search history.

(56) References Cited

U.S. PATENT DOCUMENTS

| | | | |
|---|---|---|---|
| 2,465,802 | A | 3/1949 | Hays |
| 2,724,558 | A | 11/1995 | Jones |
| 6,170,756 | B1 | 1/2001 | Adkins |
| 6,305,614 | B1 | 10/2001 | Adkins |
| 27,167 | A1 | 3/2002 | Adkins |
| 6,422,479 | B1 | 7/2002 | Adkins |

(Continued)

OTHER PUBLICATIONS

Composites International Thermoset Molding Compounds "Engineered for Performance" 2006.

(Continued)

*Primary Examiner* — Zachary L Kuhfuss
(74) *Attorney, Agent, or Firm* — Gardner Groff Greenwald & Villanueva, PC

(57) ABSTRACT

A gauge-plate insulator for positioning between and mounting to two rail-spacing members that in turn extend transversely between and mount to two parallel rails to mechanically interconnect but electrical insulate the rail-spacing members and thus the parallel rails. The insulator includes a plate, front and rear mounting holes extending vertically through the plate, and a tongue extending downward from the plate along its lateral midsection from front to back. In typical embodiments, the insulator includes elongated platforms surrounding the mounting holes and arranged perpendicular to the tongue, and the insulator is of a one-piece monolithic construction made of a material selected for mechanical strength and electric insulation. And in some embodiments the insulator includes a tented top surface, ribs extending perpendicular to the tongue, and/or multi-level platforms.

21 Claims, 9 Drawing Sheets

(56) References Cited

U.S. PATENT DOCUMENTS

| | | | | |
|---|---|---|---|---|
| 6,997,419 | B1 | 2/2006 | Remington | |
| 7,261,244 | B2 | 8/2007 | Urmson | |
| 8,042,747 | B2 | 10/2011 | Mospan et al. | |
| 9,234,314 | B2 * | 1/2016 | Habel | E01B 5/16 |
| 2002/0027167 | A1 | 3/2002 | Adkins et al. | |
| 2008/0290560 | A1 | 11/2008 | Polk | |
| 2009/0108086 | A1 | 4/2009 | Mospan et al. | |

OTHER PUBLICATIONS

Potec Rail Products, Inc. "Insulated Rail Joints Portec Rail . . . your one source for all types!" 2005.
Portec Rail Products, Inc. "Portec Poly-Insulated Gauge Plate Insulator" 2004.
International Search Report and the Written Opinion of the International Searching Authority, dated Apr. 25, 2013; Alexandria Virginia, 9 pages.
Search History: Complete Classification Search, dated Apr. 10, 2013, Alexandria Virginia, 3 pages.

* cited by examiner

RAIL GAUGE-PLATE INSULATOR

CROSS-REFERENCE TO RELATED APPLICATION

This application is a continuation of U.S. Non-provisional patent application Ser. No. 13/783,735 filed Mar. 4, 2013, which claims the priority benefit of U.S. Provisional Patent Application No. 61/609,577 filed on Mar. 12, 2012, which is hereby incorporated herein by reference.

TECHNICAL FIELD

The present invention relates generally to railroad track systems for trains and, in particular, to transverse rail-spacing gauge-plate members of such railroad track systems.

BACKGROUND

In order to maintain a uniform spacing between parallel rails of railroad track systems, transverse rail-spacing gauge-plate members are fixedly mounted between the parallel rails. The rails have traditionally been made of a metal such as steel selected for strength, durability, and electrical conductivity, while the rail-spacing members have traditionally been made of a metal such as steel selected for strength and durability but not for electrical conductivity. In addition, railroad tracks are typically divided into sections (or blocks) and each section is electrified to provide for detecting the presence of a train on any given section of the track. The train-detection systems monitor the sections of the track to determine whether the metallic rails are isolated from each other (indicating that no train is present on those track sections) or whether they are short-circuited (by a train providing an electrical path between the rails to indicate that a train is present on that track section).

To electrically insulate the parallel rails from each other, inline pairs of the rail-spacing members are provided with their outer-positioned ends mounted to the rails, their inner-positioned ends spaced apart, and a gauge-plate insulator mounted to their spaced-apart inner ends to form an electrical-insulation gap while still mechanically interconnecting them. These gauge-plate insulators are electrically insulating, so they include non-metallic (non-conducting) materials. Known gauge-plate insulators include a metallic core and a polyurethane insulating encasement. Other gauge-plate insulators have been made of a laminated SCOTCHPLY material, a high-strength fiber-reinforced phenolic material (Minnesota Mining & Manufacturing Company, Saint Paul, Minn.), and require the use of a separate insulating plug between the ends of the gauge-plate insulator to prevent material build-up that can cause an electrical short-circuit. While these known designs of gauge-plate insulators have proven operationally sufficient, they tend to be costly due to the high-performance materials required and/or their multi-piece constructions.

Accordingly, it can be seen that there exists a need for a more cost-effective yet still durable and reliable way to mechanically interconnect but electrically insulate parallel rails of railroad tracks from each other. It is to the provision of solutions to this and other problems that the present invention is primarily directed.

SUMMARY

Generally described, the present invention relates to gauge-plate insulators for use in insulating parallel rails from each other in railroad track systems. The gauge-plate insulators are each designed for positioning between and mounting to two rail-spacing members that in turn extend transversely between and mount to two parallel rails to mechanically interconnect but electrical insulate the rail-spacing members and thus the parallel rails. The insulator includes a plate, front and rear mounting holes extending vertically through the plate, and a tongue extending downward from the plate along its lateral midsection from front to back. In typical embodiments, the insulator includes elongated platforms surrounding the mounting holes and arranged perpendicular to the tongue, and the insulator is of a one-piece monolithic construction made of a material selected for mechanical strength and electric insulation. And in some embodiments the insulator includes a tented top surface, ribs extending perpendicular to the tongue, and/or multi-level platforms. In other embodiments, the gauge-plate insulator includes only some of these features, includes mounting elements other than mounting holes, includes additional features, and/or is otherwise adapted for the function and use described herein while still embodying the inventive aspects described herein.

The specific structures and techniques employed to improve over the drawbacks of the prior art and accomplish the advantages described herein will become apparent from the following detailed description of example embodiments and the appended drawings and claims.

BRIEF DESCRIPTION OF THE DRAWING FIGURES

DETAILED DESCRIPTION OF EXAMPLE EMBODIMENTS

Figure 1:
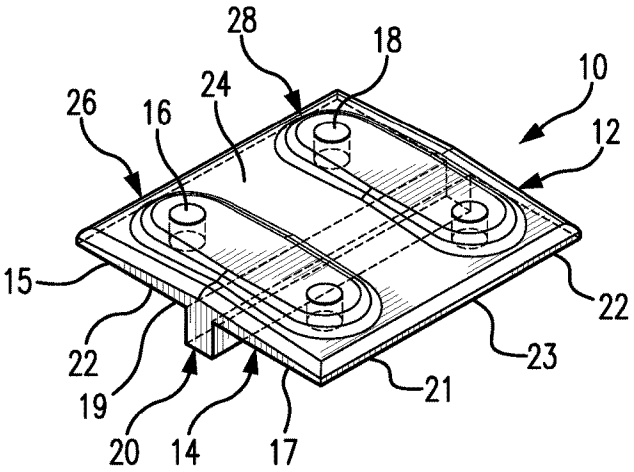
FIG. 1 is a top perspective view of a gauge-plate insulator according to a first example embodiment of the present invention.
Figure 2:
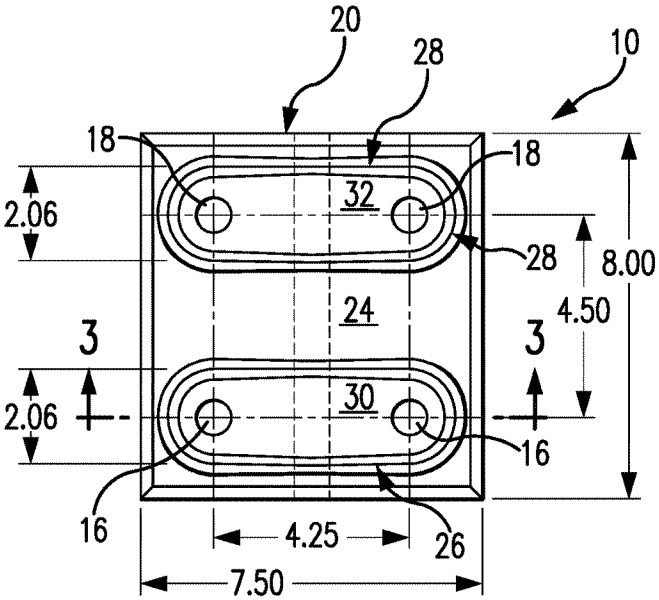
FIG. 2 is a top view of the gauge-plate insulator of FIG. 1.
Figure 4:
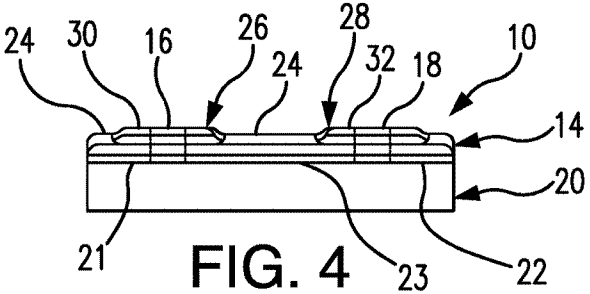
FIG. 4 is a side view of the gauge-plate insulator of FIG. 2.

The present invention relates to gauge-plate insulators for use in insulating parallel rails from each other in railroad track systems. The gauge-plate insulators are fixedly mounted between two rail-spacing gauge-plate members to separate (insulate) them electrically but not mechanically (structurally). And the rail-spacing members extend generally transversely to and are fixedly mounted between two parallel rails to maintain their uniform spacing during use. In typical commercial embodiments, the two rail-spacing members are elongated members made of metal, arranged inline with each other and transverse to the parallel rails, and having outer ends and inner ends, with each of the outer ends fixedly mounted to a respective one of the two parallel rails, with the inner ends spaced apart to form an electrical-insulating gap, and with a gauge-plate insulator mounted to the spaced-apart inner ends to maintain the electrical-insulation gap while mechanically interconnecting the gauge-plate members.

In other embodiments, the gauge-plate insulator is adapted for use with gauge-plate members with other forms, materials, and arrangements, including non-elongated and/or non-inline rail-spacing members. Thus, in one alternative embodiment, the two rail-spacing members are parallel but not aligned, with their inner ends overlapping, and with the gauge-plate insulator extending generally parallel to the rails and mounted between the rail-spacing members. In another alternative embodiment, one rail-spacing member extends transverse to the rails, is mechanically and electrically connected to a first one of the rails, and has an end that is spaced apart from a second one of the rails, with the gauge-plate member and the second rail spaced apart to form the electrical-insulating gap, and with the gauge-plate insulator mounted between the gauge-plate member end and the second rail. And in yet another alternative embodiment, more than two rail-spacing members extend between the rails and more than one gauge-plate insulator electrically separates but mechanically interconnects them. Accordingly, it will be understood that the present invention is not limited to the specific example embodiments disclosed herein.

Referring now to the drawings, FIGS. 1-5 show a gauge-plate insulator 10 according to a first example embodiment of the present invention. The gauge-plate insulator 10 mounts to and extends between spaced-apart inner-positioned portions 7 of two rail-spacing members 8. And outer-positioned portions 9 of the rail-spacing members 8 fixedly mount, for example by conventional fasteners known in the art, to two parallel rails 6. The gauge-plate insulator 10 includes a body 12 having a plate 14, two pairs of mounting holes 16 and 18 extending through the plate, and a spacing tongue 20 extending from the plate.

The plate 14 has a bottom surface 22 and a top surface 24. Typically, the bottom surface generally conforms to upper surfaces of the rail-spacing members 8 so that the opposing surfaces are generally flush with each other. In the depicted embodiment, for example, the plate bottom surface 22 is generally flat as are the upper surfaces of the rail-spacing members 8. Typically, the plate top surface 24 is tented when viewed from the front (see FIGS. 1 and 3). And typically the plate 14 has the generally rectilinear shape of a square or other rectangle when viewed from the top (see FIG. 2), though in other embodiments the plate can have other shapes such as another rectilinear shape, a polygonal shape, a circular shape, or another regular or irregular shape.

Figure 3:
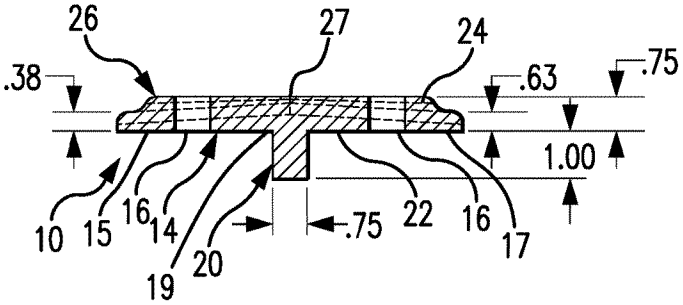
FIG. 3 is a front cross-sectional view of the gauge-plate insulator of FIG. 2 taken at line 3-3 thereof.

In the depicted embodiment, the plate top surface 24 is tented with a gentle slope to form a triangular or double-wedge-shaped profile with a peak 27 when viewed from the front (see FIGS. 1 and 3). Thus, the distance (height) between the bottom surface 22 and the top surface 24 is smaller at the outer edges of the side sections 15 and 17 of the plate 14 than at the inter-side (lateral) midsection 19 of the plate adjacent the tongue 16. This tented-plate feature advantageously provides for increased twisting-torque and flex strength of the gauge-plate insulator 10 while minimizing weight and material usage.

In a typical commercial embodiment having a rectangular plate 14 with plan-view peripheral dimensions of about 7.5 inches by 8.0 inches (see FIG. 2) and with the plate having a thickness of about 0.63 inches at its side edges (see FIG. 3), the gentle slope of each side section of the top surface 24 relative to horizontal (typically the bottom surface 24) when installed forms an angle of about 1.8 degrees to about 5.8 degrees, and preferably about 3.8 degrees (see FIGS. 1 and 3). The two side sections 15 and 17 of the triangular top surface 24 are ramped upwardly/inwardly to form this tented-plate feature. In the depicted embodiment, for example, the two ramped side sections of the triangular top surface 24 are generally planar and inclined, though in other embodiments they are curved (e.g., convex so that the resulting "triangular" shape is "domed"), ribbed, undulated, or the like.

The pairs of mounting holes 16 and 18 extend generally vertically all the way through the plate 14. The front mounting-hole pair 16 is positioned on the front end section 21 of the plate 14 and the rear mounting-hole pair 18 is positioned on the end section 23 rear of the plate. Thus, the left-side holes of the front and rear mounting-hole pairs 16 and 18 are located in the left-side section 15 of the plate 14, while the right-side holes of the front and rear mounting-hole pairs are located in the right-side section 17 of the plate. In the depicted embodiment, the mounting holes 16 and 18 are generally circular and peripherally defined by the plate 14, though in other embodiments the mounting holes are formed by notches in the front and/or rear edges of the plate. In the depicted embodiment, the plate includes two front mounting holes 16 and two rear mounting holes 18, though in other embodiments there are more or fewer mounting holes, as long as there is at least one front mounting hole and at least one rear mounting hole. Thus, in some embodiments more than four mounting holes are provided.

Platforms 26 and 28 surround each of the mounting-holes pairs 16 and 18, respectively. Thus, the front platform 26 is elongated and surrounds both holes 16 of the front mounting-hole pair and the rear platform 28 is elongated and surrounds both holes 18 of the rear mounting-hole pair. This platform feature provides for increased twisting-torque and flex strength of the gauge-plate insulator 10 while minimizing weight and material usage.

The platforms 26 and 28 extend generally vertically upward from the top surface 24 of the plate 14. In the depicted embodiment, the platforms 26 and 28 have top surfaces 30 and 32, respectively, that are generally flat and thus are at a generally uniform distance from the generally flat bottom surface 22 of the plate 14. In other embodiments, the platform top surfaces 30 and 32 have ramped, curved, ribbed, or other shapes. The platforms 26 and 28 can have a generally elliptical plan shape (see FIGS. 1-2) with semicircular sides and elongate linear fronts and backs, as depicted, or other shapes such as rectangular, oval, or another regular or irregular shape. The front and rear platforms 26 and 28 are positioned on the front and rear sections 21 and 23 of the plate 14, respectively, and are spaced apart front-to-rear so that the inter-end midsection 25 of the top surface 24 of the plate is exposed between them. And in the depicted embodiment the front and rear platforms 26 and 28 are spaced from the front and rear edges of the plate 14 so that front-edge and rear-edge portions of the plate are exposed, respectively, though in other embodiments the front and rear platforms extend all the way to the front and rear edges of the plate, respectively.

In embodiments with more or fewer than two front and/or rear mounting holes 16 and 18, the front and rear platforms 26 and 28 surround a corresponding number of mounting holes. For example, in an embodiment with one front and one rear mounting holes, the front and rear platforms each surround only one mounting hole. And in an embodiment with four front and four rear mounting holes, the front and rear platforms each surround four mounting holes. In addition, in some embodiments with multiple front and/or multiple rear mounting holes, each platform surrounds only one mounting hole, so there can be multiple front and/or rear platforms.

Figure 5:
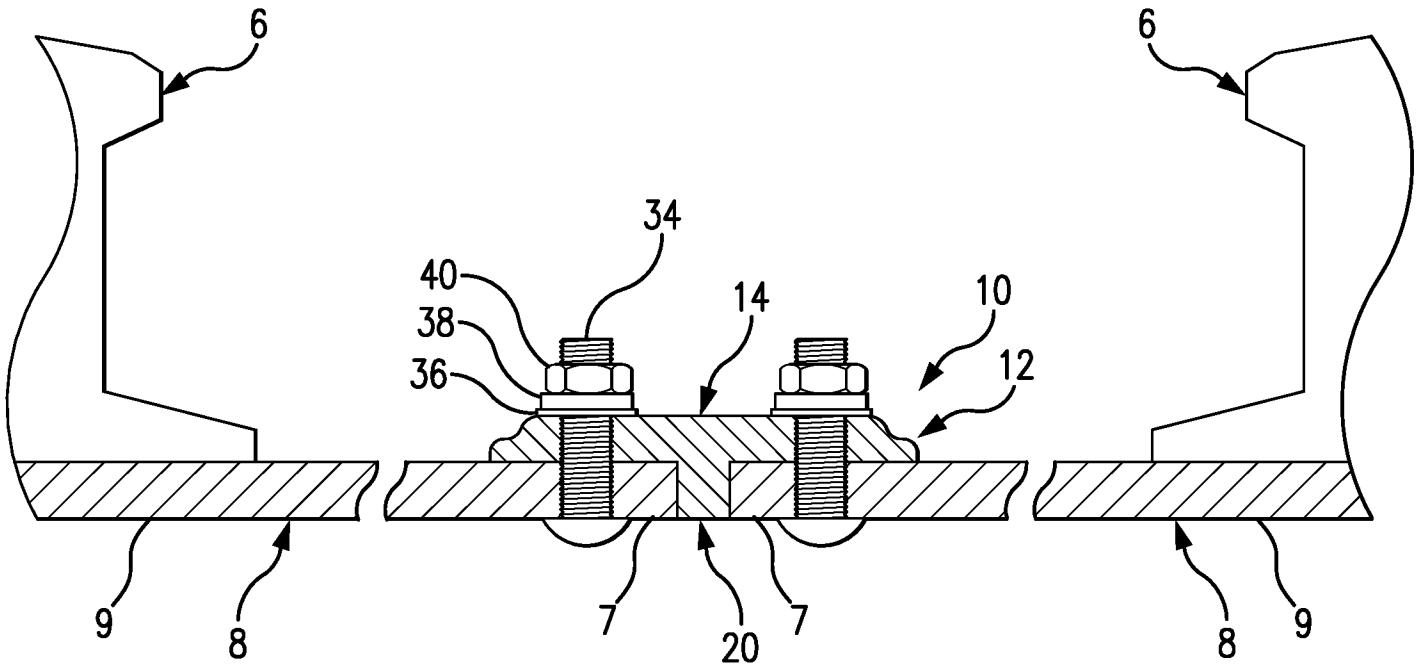
FIG. 5 is a front view of the gauge-plate insulator of FIGS. 1-4 installed in use, showing the gauge-plate insulator mounted between two rail-spacing members that in turn are mounted between two rails, with the gauge-plate insulator and the rail-spacing members shown in cross section.
Figure 6:
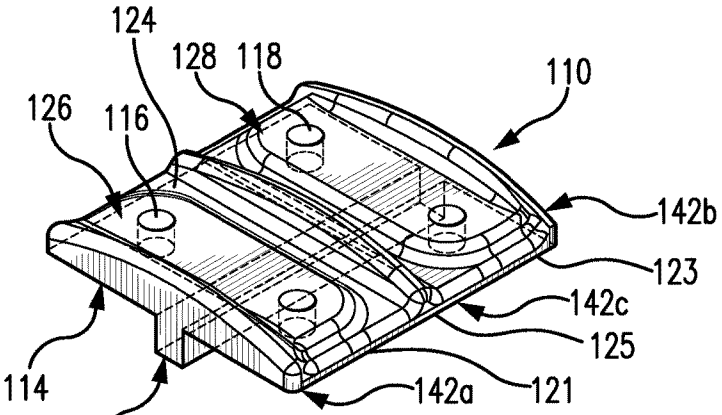
FIG. 6 is a top perspective view of a gauge-plate insulator according to a second example embodiment of the present invention.
Figure 9:
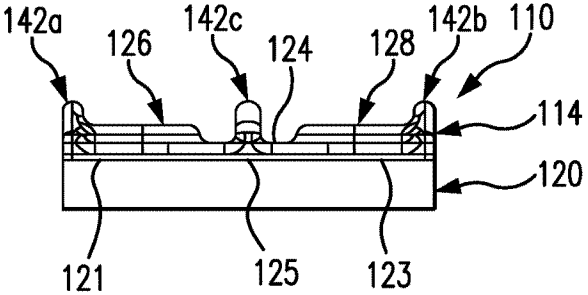
FIG. 9 is a side view of the gauge-plate insulator of FIG. 7.
Figure 7:
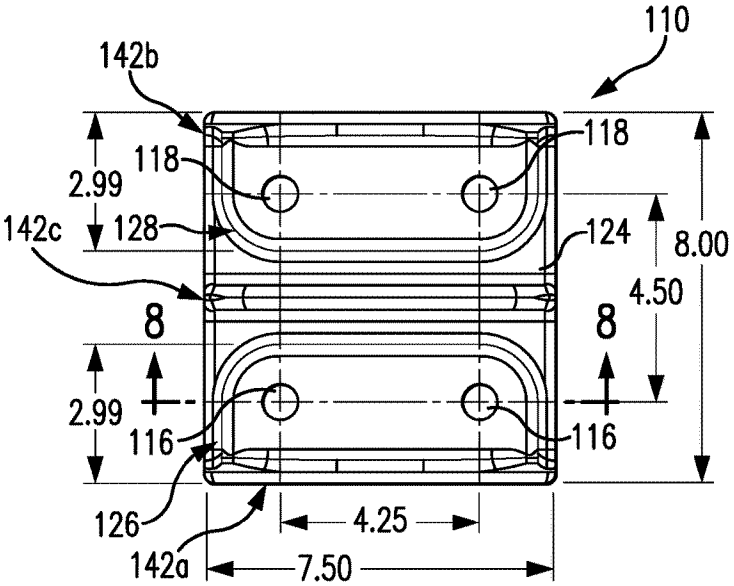
FIG. 7 is a top view of the gauge-plate insulator of FIG. 6.
Figure 8:
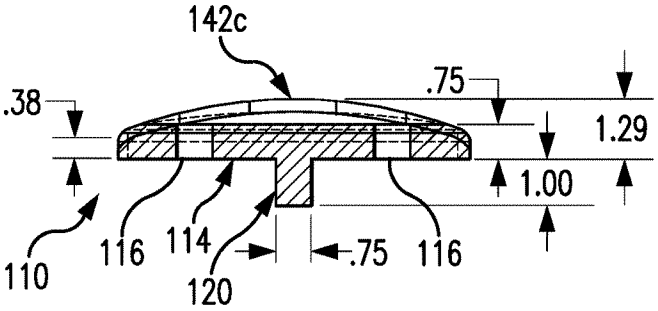
FIG. 8 is a front cross-sectional view of the gauge-plate insulator of FIG. 7 taken at line 8-8 thereof.
Figure 10:
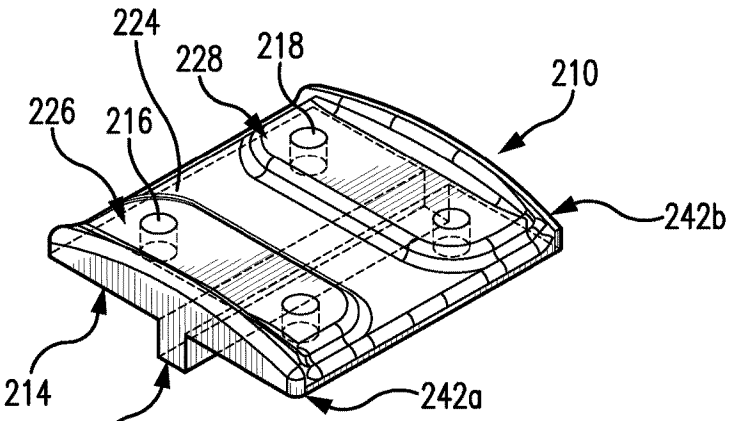
FIG. 10 is a top perspective view of a gauge-plate insulator according to a third example embodiment of the present invention.
Figure 13:
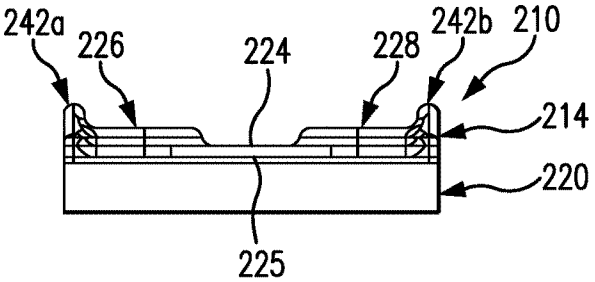
FIG. 13 is a side view of the gauge-plate insulator of FIG. 11.
Figure 11:
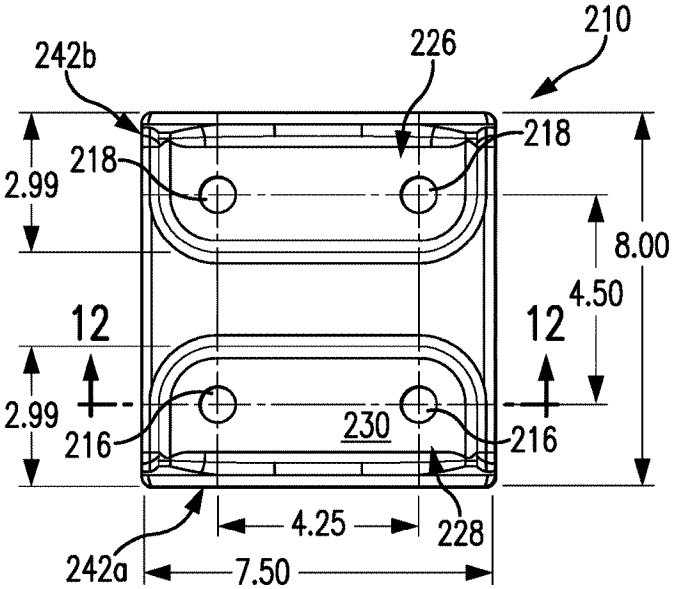
FIG. 11 is a top view of the gauge-plate insulator of FIG. 10.
Figure 12:
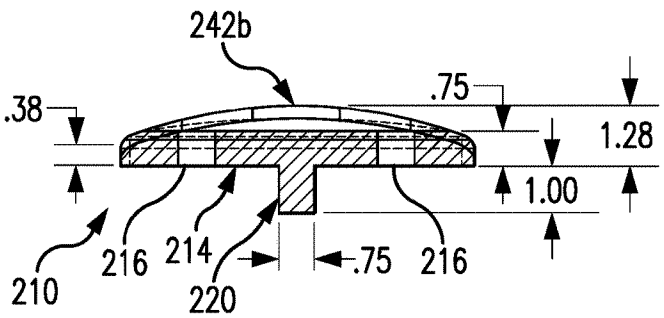
FIG. 12 is a front cross-sectional view of the gauge-plate insulator of FIG. 11 taken at line 12-12 thereof.

The mounting-hole pairs 16 and 18 align with corresponding mounting holes in the rail-spacing members 8 so that the aligned holes can receive fasteners to secure the gauge-plate insulator 10 to the rail-spacing members 8 (see FIG. 5). In the depicted embodiment, the fasteners are provided by bolts 34 that extend through the aligned holes, along with retainer washers 36, lock washers 38, and nuts 40 for mounting onto the bolt. In other embodiments, the fasteners 34 are provided by other conventional fastening structures as are known in the art and are suitable for fastening the gauge-plate insulator 10 to the rail-spacing members 8, such as clamps, clips, screws, bands, or the like. In some such embodiments, the mounting hole pairs are provided by other mounting elements such as grooves or wells, or flat areas with frictional gripping surfaces, for receiving ends of clips, clamps, or bands, though the platforms are still included in the same positions to provide locations for the fasteners to mount the gauge-plate insulator to the rail-spacing members 8. In some embodiments the rail-spacing members include integral upwardly extending fasteners (e.g., bolts or pins) that align with and are received in the mounting holes 16 and 18. And in other embodiments the gauge-plate insulator includes integral downwardly extending fasteners (e.g., bolts or pins) that align with and are received in mounting holes formed in the rail-spacing members.

The tongue 20 extends generally vertically downward from the plate 14 along its lateral midsection 19, typically horizontally front-to-rear substantially all the way along the plate from the front section 21 to the rear section 23 (see FIG. 3). Thus, the tongue 20 separates and splits the two holes of the first mounting-hole pair 16, separates and splits the two holes of the second mounting-hole pair 18, and is positioned between the left-side and right-side sections 15 and 17 of the plate 14, with the tongue 20 positioned generally perpendicular to the elongated platforms 26 and 28 (see FIGS. 1-2). The tongue 20 can be provided by any protruding element such as a rib, finger, bar, series of stubs, or the like. In the depicted embodiment, the tongue 20 has the generally rectilinear shape of a rectanguloid, though in other embodiments the tongue can have another shape such as semi-cylindrical, rectangular with a curved free (bottom) end, or another regular or irregular shape.

The tongue 20 has a horizontal thickness (at its thickest point), when viewed from the front (see FIG. 3), selected for maintaining a minimum horizontal physical separation/insulation gap between the horizontally spaced-apart rail-spacing members 8. In some embodiments such as that depicted, the tongue 20 has a height when viewed from the front (see FIGS. 3 and 5) that is substantially the same (or greater) than the thickness of the rail-spacing members 8, and a width when viewed from the side (see FIG. 4) that is substantially the same (or greater) than the width of the rail-spacing members, so that the tongue functions as an electrical insulator between the closest portions (the inner ends 7) of the two rail-spacing members. In other embodiments, the tongue has a height that is less than the thickness of the rail-spacing members and/or a width that is less than the width of the rail-spacing members so that the tongue functions primarily as a spacer to maintain the physical separation/insulation gap between the horizontally spaced-apart rail-spacing members 8 while air (or another material) at least partially provides the insulating function. And in yet other embodiments, the gauge-plate insulator is provided without the tongue and as such it does not function as a spacer or an insulator in the gap between the two facing ends of the rail-spacing members, with the horizontal physical separation/insulation gap between the horizontally spaced-apart rail-spacing members 8 maintained by the securement of the gauge-plate insulator to the rail-spacing members by the fasteners.

In typical embodiments such as those illustrated in the drawings (see FIGS. 3 and 5), the gauge-plate insulator 10 is of a one-piece, monolithic, solid-body construction, though in other embodiments it can be made of multiple pieces that are assembled together. The one-piece gauge-plate insulator 10 is made of a single material selected for high mechanical strength and high electrical insulation/resistance based on industry-standard design mechanical loads and electric currents. Preferably, the material is also selected for high UV resistance so that its mechanical strength and electrical insulation properties do not degrade to unacceptable levels over time with prolonged exposure to the sun, though in other embodiments a UV resistant shield or coating is mounted over or applied to the insulator. And preferably the material is also selected for superior flame-retardant properties (to avoid melting and the resulting degradation of mechanical strength and electrical insulation properties), reduced toxic emissions (for environmental friendliness), and light weight (for ease of transport and installation). For example, the material can be a fiberglass-reinforced polyester or an aramid composite (e.g., KEVLAR-brand or TWARON-brand para-aramid materials). In typical commercial embodiments, the material that the gauge-plate insulator 10 is made of is a sheet-molding compound (SMC) such as that commercially available under the product designation "46 16-60 SMC Gray" from IDI Composites International (Noblesville, Ind.). In other embodiments, the material that the gauge-plate insulator 10 is made of is another material, such as a bulk-molding compound (BMC), that is commercially available from IDI Composites International (Noblesville, Ind.) and/or other suppliers.

FIGS. 6-9 show a gauge-plate insulator 110 according to a second example embodiment of the present invention. The gauge-plate insulator 110 is similar to that of the first embodiment. For example, it is positioned between and mounts to two rail-spacing members that in turn extend transversely between and mount to two parallel rails, and it includes a plate 114, two pairs of mounting holes 116 and 118 extending through the plate, and a tongue 120 extending from the plate.

In this embodiment, however, the gauge-plate insulator 110 additionally includes one or more ribs 142 extending generally vertically upward from the top surface 124 of the plate 114. This ribbed-plate feature advantageously provides for increased twisting-torque and flex strength of the gauge-plate insulator 110 while minimizing weight and material usage. In the depicted embodiment, for example, the gauge-plate insulator 110 includes a front rib 142*a*, a rear rib 142*b*, and a center rib 142*c* (collectively, the ribs 142"). In other embodiments, fewer or more ribs 142 can be provided on the plate 114, for example, only the center rib can be provided. Unlike the first embodiment, the top surface 124 of the plate 114 is not tented and instead is for example generally flat, while in other embodiments including the ribs the plate top surface is tented (peaked).

The front and rear ribs 142*a* and 142*b* are positioned at the front and rear outer edges of the front and rear sections 121 and 123, respectively, of the plate 114 such that the plate top surface 124 is not exposed between the platforms 126 and 128 and the front and rear edges of the plate, respectively. That is, the front rib 142*a* and the front platform 126 form one continuous elevated front element, and the rear rib 142*b* and the rear platform 128 form one continuous elevated rear element (see FIG. 9). And the center rib 142*c* is positioned between the front and rear ribs 142*a* and 142*b*, and between the front and rear platforms 126 and 128, in the inter-end midsection 25 of the plate top surface 124 between the front and rear platforms (see FIG. 9). In typical embodiments, the ribs 142 extend side-to-side substantially all the way across the plate 114 (see FIGS. 6-8). The ribs 142 are positioned generally perpendicular to the tongue 20, and generally parallel to the elongated platforms 126 and 128, to provide increased twisting-torque and flex strength of the gauge-plate insulator 110 while minimizing weight and material usage.

FIGS. 10-13 show a gauge-plate insulator 210 according to a third example embodiment of the present invention. The gauge-plate insulator 210 is similar to that of the second embodiment. For example, it is positioned between and mounts to two rail-spacing members that in turn extend transversely between and mount to two parallel rails, and it includes a plate 214, two pairs of mounting holes 216 and 218 extending through the plate, and a tongue 220 extending from the plate.

In this embodiment, however, the gauge-plate insulator 210 includes a different arrangement of ribs 242. In particular, the gauge-plate insulator 210 includes front and rear ribs 242*a* and 242*b*, but it does not include a center rib between the front and rear ribs 242*a* and 242*b*. Thus, the entire inter-end midsection 225 of the plate top surface 224 between the front and rear platforms 226 and 228 is exposed (see FIG. 13). This embodiment provides similar advantages to that of the second embodiment, and is well-suited for designs using a stronger material and/or for applications with lesser mechanical loads.

FIGS. 14-21 show a gauge-plate insulator 310 according to a fourth example embodiment of the present invention. The gauge-plate insulator 310 is similar to that of the first and second embodiments. For example, it is positioned between and mounts to two rail-spacing members that in turn extend transversely between and mount to two parallel rails, and it includes a plate 314, two pairs of mounting holes 316 and 318 extending through the plate, and a tongue 320 extending from the plate.

Figure 14:
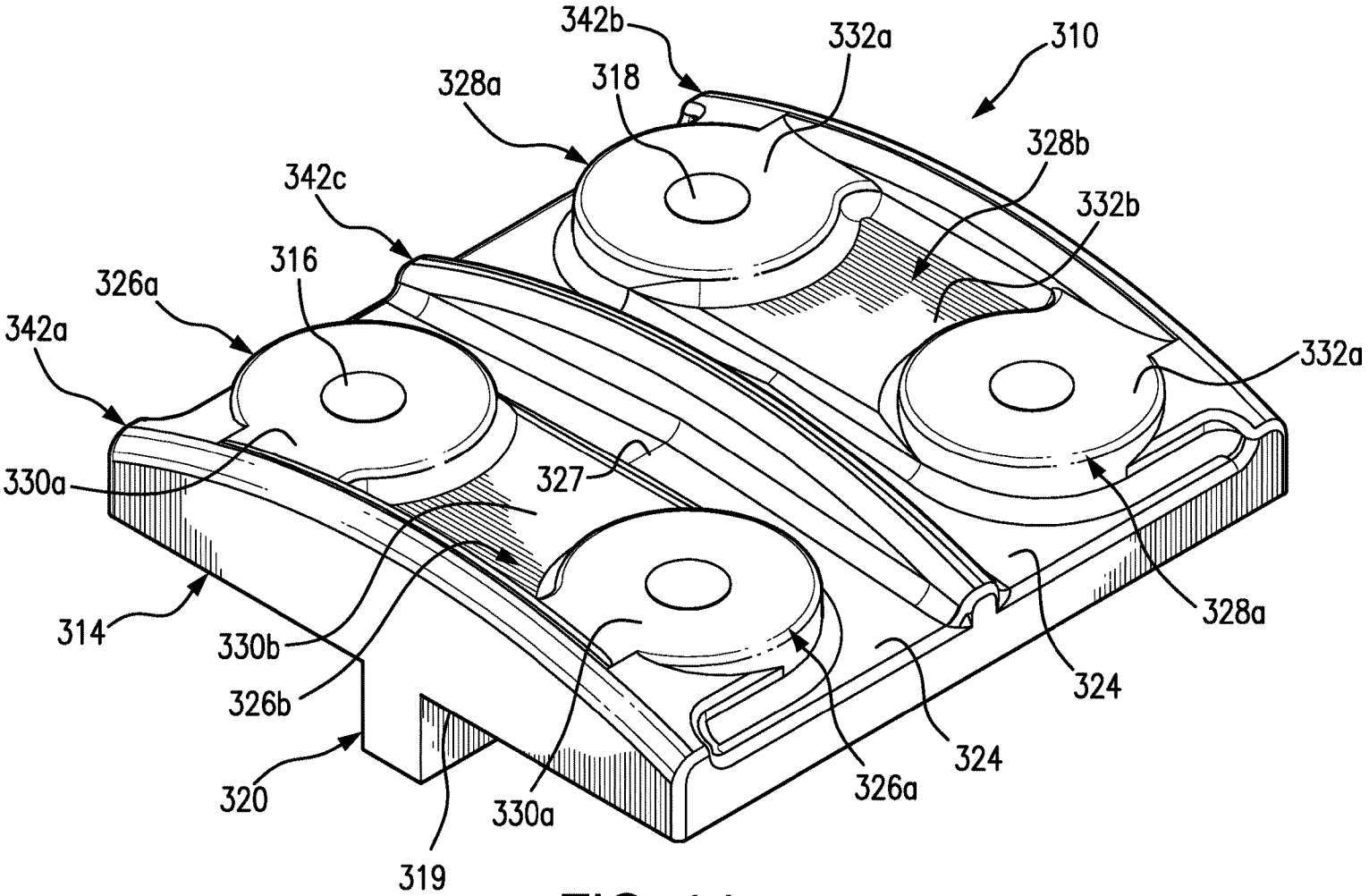
FIG. 14 is a top perspective view of a gauge-plate insulator according to a fourth example embodiment of the present invention.
Figure 15:
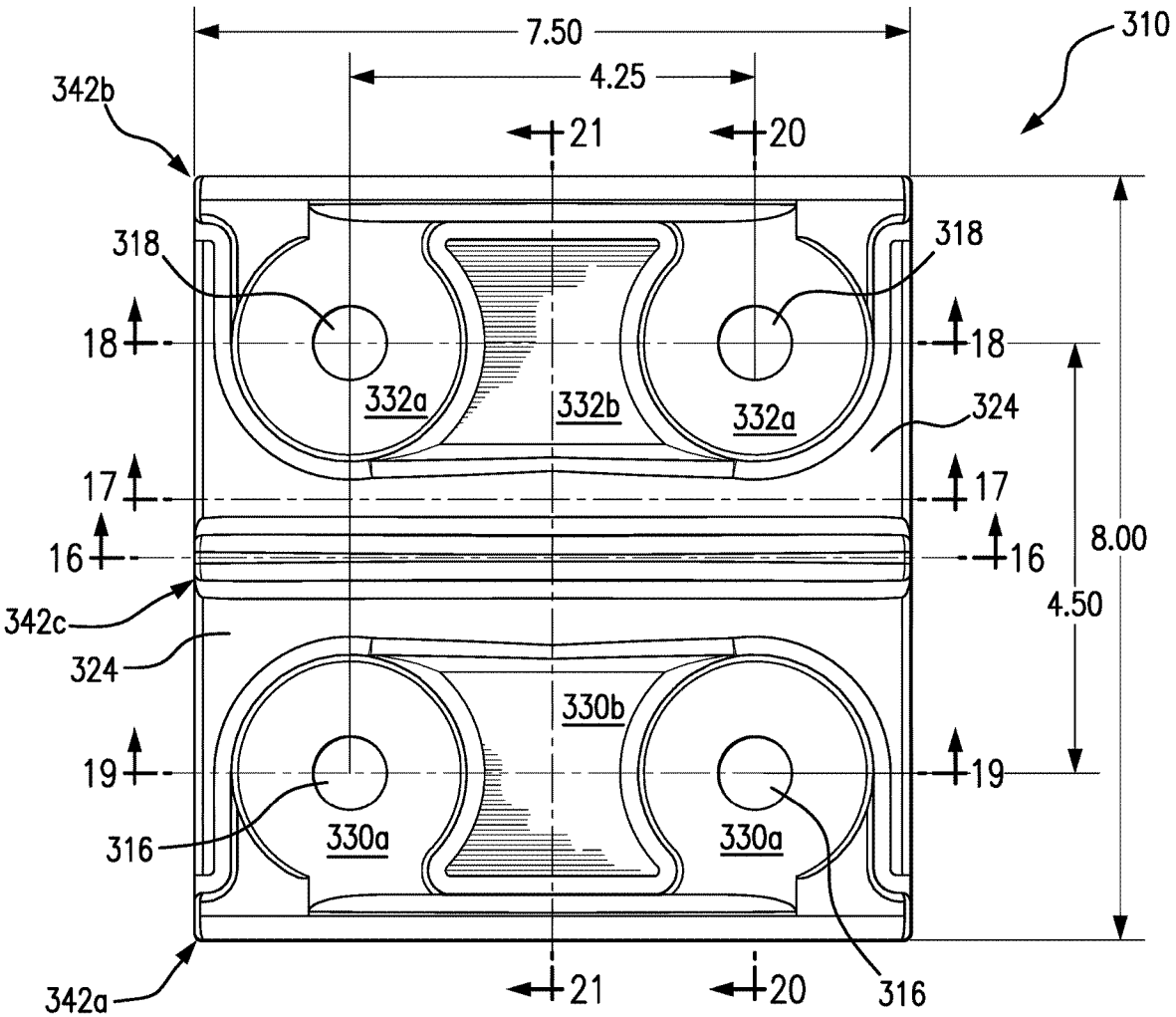
FIG. 15 is a top view of the gauge-plate insulator of FIG. 14.
Figure 16:
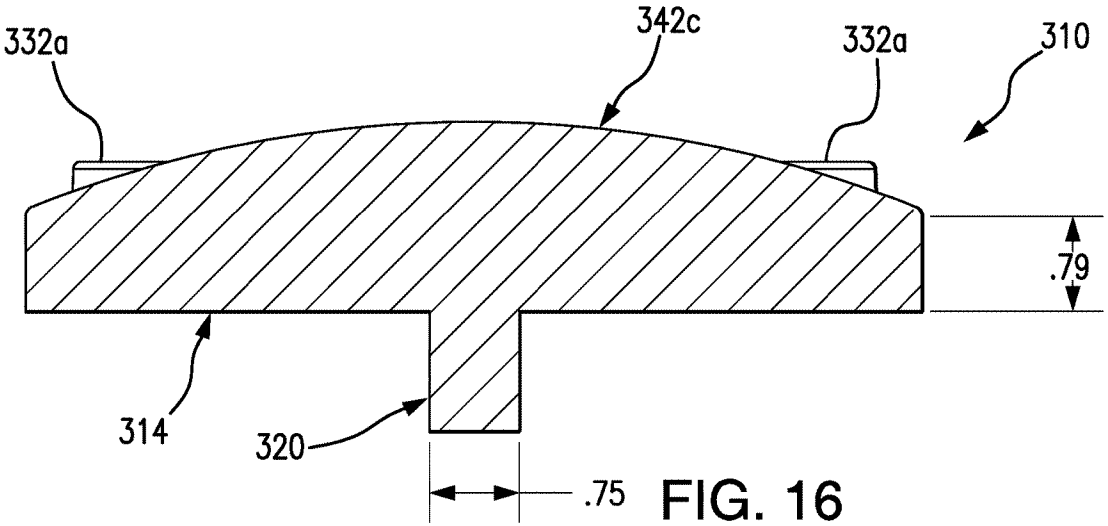
FIG. 16 is a front cross-sectional view of the gauge-plate insulator of FIG. 15 taken at line 16-16 thereof.
Figure 21:
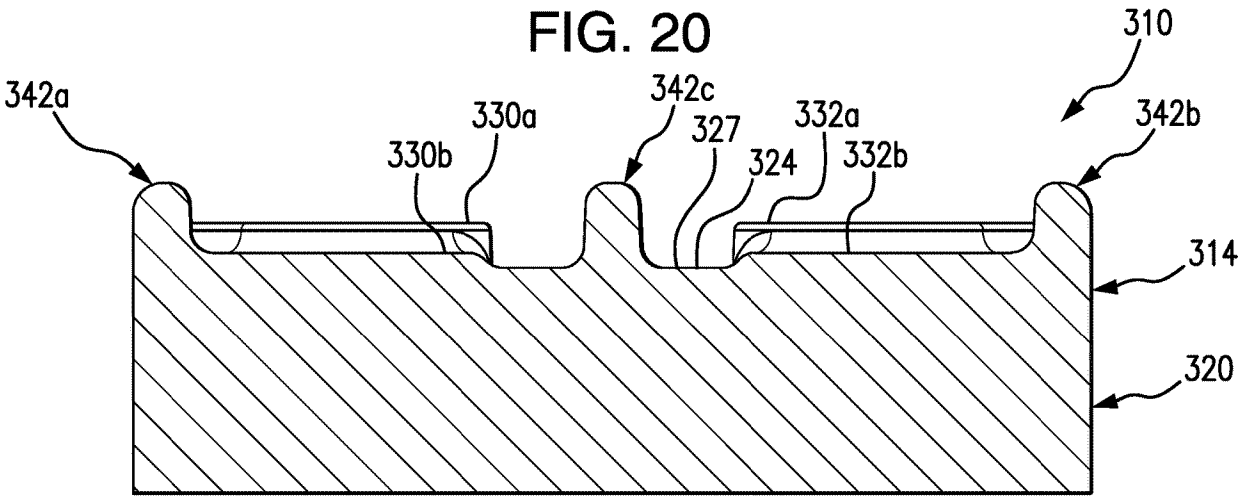
FIG. 21 is a side cross-sectional view of the gauge-plate insulator of FIG. 15 taken at line 21-21 thereof.

In this embodiment, the gauge-plate insulator 310 includes the tented plate top surface 324 of the first embodiment (see FIGS. 17 and 20) and the ribs 342 of the second embodiment (see FIGS. 14 and 21). In addition, the gauge-plate insulator 310 includes multi-level platforms 326 and 328 surrounding the front and rear mounting-hole pairs 316 and 318, respectively. The platforms 326 and 328 each include two upper platform levels 326*a* and 328*a* and a lower platform level 326*b* and 328*b* between them. This embodiment provides similar advantages to that of the second embodiment, but uses less material without sacrificing strength.

In the depicted embodiment, for example, the front upper platform levels 326*a* each individually surround a corresponding one of the two front mounting holes 316, but they do not extend laterally across the plate 314 between the two front mounting holes. Instead, the front lower platform level 326*b* extends laterally across the plate 314 between the two front upper platform levels 326*a* and thus between the two front mounting holes 316. Similarly, the rear upper platform levels 328*a* each individually surround a corresponding one of the two rear mounting holes 318, but they do not extend laterally across the plate 314 between the two rear mounting holes. Instead, the rear lower platform level 328*b* extends laterally across the plate 314 between the two rear upper platform levels 328*a* and thus between the two rear mounting holes 318. Thus, the top surfaces 330*a* and 332*a* of the upper platform levels 326*a* and 328*a* are positioned above the top surfaces 330*b* and 332*b* of the lower platform levels 326*b* and 328*b*. And the top surfaces 330*b* and 332*b* of the lower platform levels 326*b* and 328*b* are positioned above the top surface 324 of the plate 314 at least at the left-side section 315 and the right-side section 317 of the plate.

In embodiments with more than two front mounting holes, the same design concept can be applied such that each mounting hole has a dedicated upper platform level surrounding it and adjacent upper platform levels are connected by a lower platform level extending between them. The same design concept can be readily applied to embodiments having more than one rear mounting hole, as would be understood by a person of ordinary skill in the art.

Figure 17:
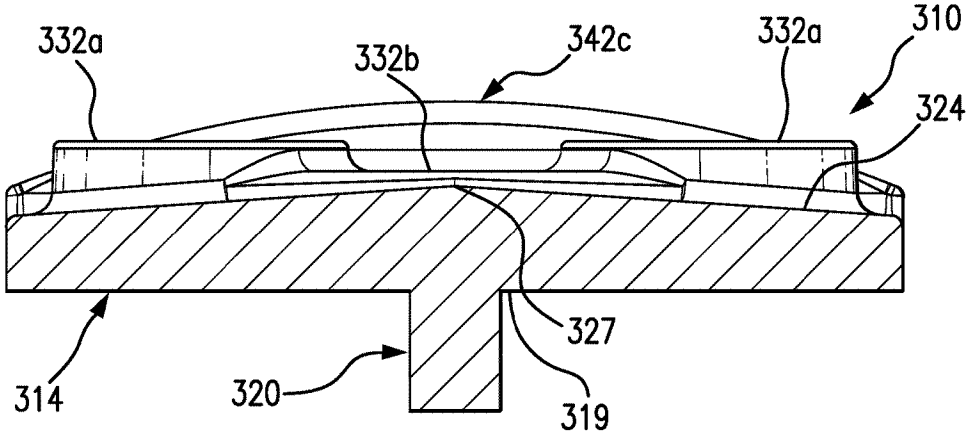
FIG. 17 is a front cross-sectional view of the gauge-plate insulator of FIG. 15 taken at line 17-17 thereof.
Figure 18:
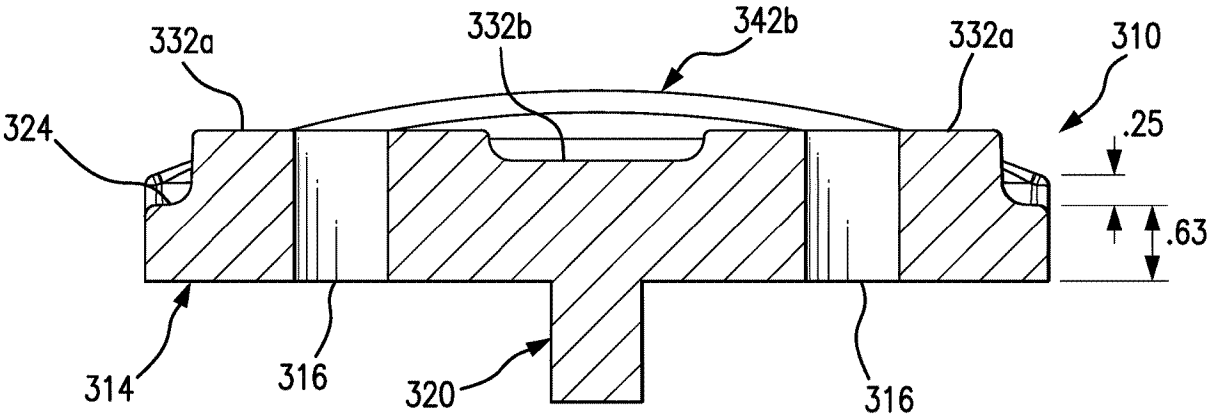
FIG. 18 is a front cross-sectional view of the gauge-plate insulator of FIG. 15 taken at line 18-18 thereof.
Figure 19:
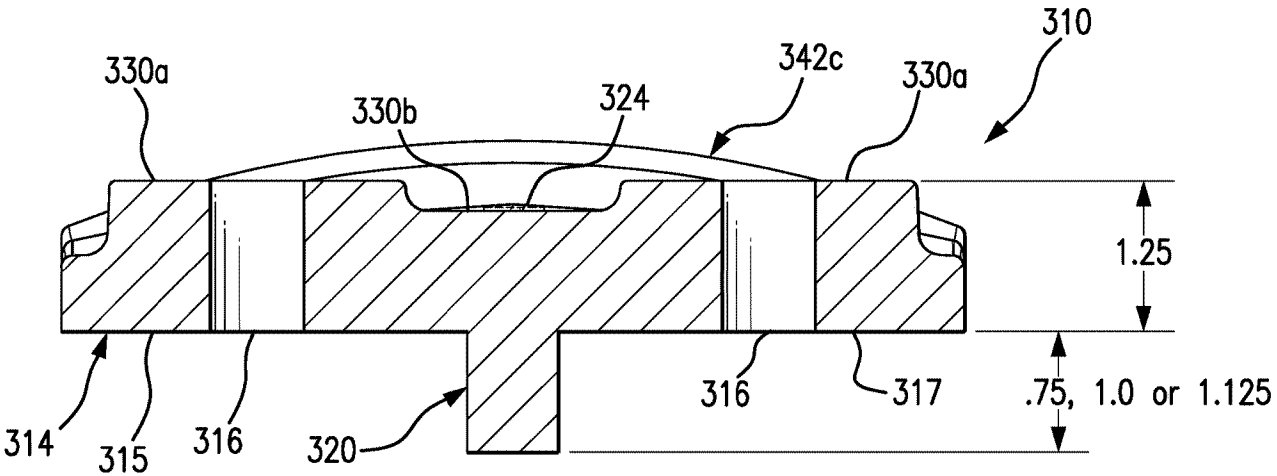
FIG. 19 is a front cross-sectional view of the gauge-plate insulator of FIG. 15 taken at line 19-19 thereof.
Figure 20:
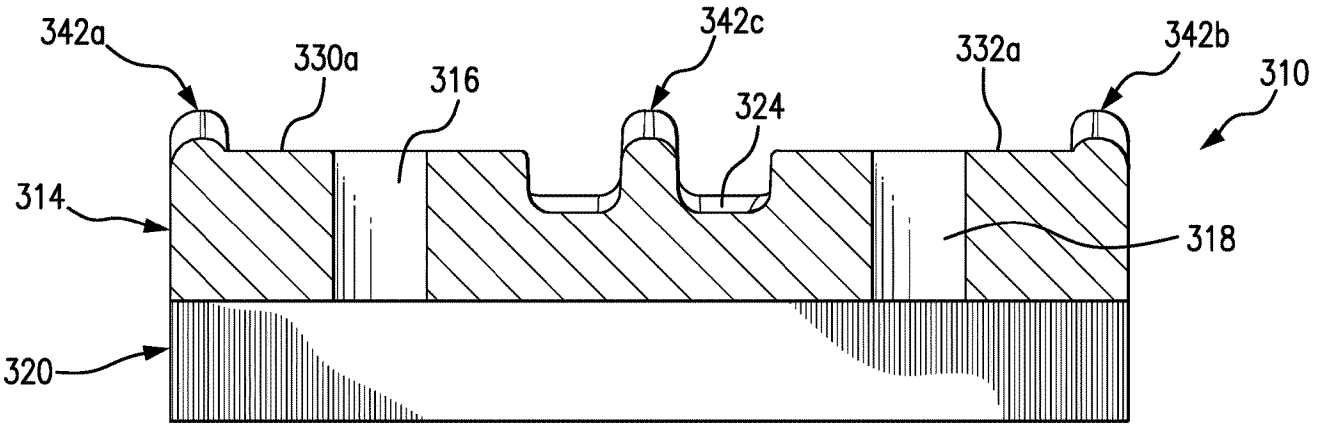
FIG. 20 is a side cross-sectional view of the gauge-plate insulator of FIG. 15 taken at line 20-20 thereof.

Typically, the top surface 324 of the plate 314 is tented with its peak 327 extending generally parallel to the tongue 320 along the lateral midsection 319 (see FIGS. 14 and 17). And typically the ribs 342 are generally parallel to the elongated platforms 326 and 328 (see FIGS. 14-15). But typically the plate top surface peak 327 and/or the tongue 320 are/is not generally parallel to the ribs 342 and/or the elongated platforms 326 and 328, but instead are generally perpendicular to each other. For example, in typical embodiments such as that depicted, the generally parallel plate top surface peak 327 and tongue 320 are generally perpendicular to the generally parallel ribs 342 and elongated platforms 326 and 328. This arrangement provides for increased twisting-torque and flex strength of the gauge-plate insulator 310 while minimizing weight and material usage. In other embodiments, the gauge-plate insulator includes only one or more than two multi-level platforms surrounding any number of mounting holes or other mounting elements. And in yet other embodiments, the gauge-plate insulator includes a number of the multi-level platforms without any ribs and/or without the tented plate top surface.

Having described several example embodiments of the invention, additional alternatives will now be addressed. In typical embodiments such as those illustrated in the drawings, only one of the gauge-plate insulators is installed inline between two rail-spacing members. In other embodiments the gauge-plate insulators have one-half-height tongues and two of them are stacked (in a tongue-to-tongue arrangement, within the bottom insulator inverted) and installed inline between and sandwiching two rail-spacing members. And in yet other embodiments two such gauge-plate insulators are integrally formed as a single piece having the shape of an "H" on its side.

Moreover, in typical embodiments such as those illustrated in the drawings, the insulators are installed between two rail-spacing members, though in other embodiments they can be adapted for use as switch-rod insulators and installed between two switch-rod members. In other embodiments, the insulators can be adapted for use as another type of railroad-track system insulator.

The dimensions shown in the drawing figures are in inches, are typical of example commercial embodiments, and provided for illustration purposes only. In other embodiments, the gauge-plate insulator is provided with different dimensions selected based on the particular size and shape of the body, the particular material used, the particular application (e.g., based on the speed and weight of the train, or the electric current and voltage of the detection system), and other such relevant design considerations. As such, the dimensions in the drawings are representative and not limiting of the invention.

The design of the gauge-plate insulator, as well as its manufacture and use, are innovative in the rail industry. Standard engineering practices for rail and track accessories are to fabricate parts from off-the-shelf materials, without using CAD or CAM technologies. Typically, stock materials are selected with dimensions nearest to what is desired. And even when new materials have been used to make gauge-plate insulators, conventional practice has still been to fabricate stock sheet/strip materials into end products. This leads to wasted materials and overly cumbersome parts that have to be manhandled into position, thereby requiring excessive quantities and qualities of physical labor.

On the other hand, the gauge-plate insulator is designed from the ground up to perform its structural/mechanical and electrical-insulation functions and at the same time to be quick and easy to install. The gauge-plate insulator was designed using CAD technology to withstand severe tensile stresses applied to it during use due to rail expansion, as well as severe tensile stresses applied to it during installation. For example, in some embodiments the design of the gauge-plate insulator is based on the maximum bending stress and the maximum tensile stress for the material used. Whereas conventional gauge-plate insulator designs are limited to the traditional T-shaped and flat profiles, the unique profile of the gauge-plate insulator maximizes the strength with a minimum of material used. The unique profile of the insulator was created and then refined through multiple trial circles using CAD technology and finite-element analysis. By going beyond traditional good engineering practices for this industry and using design and production methods that are non-standard for this industry, the innovative design of the gauge-plate insulator is unique, an advance beyond past designs, and beyond what normal and standard design procedures for this industry could have produced.

In another aspect of the invention, there is provided a method of manufacturing the gauge-plate insulator. The gauge-plate insulator can be made using conventional manufacturing techniques and equipment, such as for example compression molding of plastics. The manufacturing method includes providing a mold, filling the mold with the selected material (described above with respect to the first embodiment), and drying or curing the material into a rigid piece. Preferably, this is done using CAM technology. In addition, the method can include the step of compressing the material in the mold, before and/or during drying/curing it, using conventional compression-molding equipment and techniques, to provide a denser finished material with high flex modulus potential.

In addition, the step of filling the mold can include producing a unique internal flow pattern within the material placed into the mold. Composite materials are unique in that their strength varies from application to application. The normal procedure is to place the material in a mold in the easiest and fastest way that provides a complete part. Other known efforts in this area have placed reinforcement elements in a preset pattern (aligned along the part front-to-back, aligned across the part side-to-side, or arranged randomly) based on the profile of the fabricated part and the placement of the materials. In the present manufacturing method, however, the material is placed in a mold in such a way that the reinforcements flow and align to provide strength beyond what a normal part would have.

In use, the gauge-plate insulator mechanically connects the two metal rail-spacing members 8 (and thus the two parallel rails 6). Because of the structural design of the gauge-plate insulator, it withstands the mechanical stresses it is subjected to in its normal use, and because of its high electrical-insulating capability the two rail-spacing members 8 (and thus the two parallel rails 6) are electrically insulated from each other. In addition, because of its unique design features described herein, the gauge-plate insulator is fail-safe electrically in the event it does somehow fracture. This is because for a failure of the insulator body in tension there is no internal metal core or other conductive material that could be exposed and thus across which the electricity could travel to short-circuit the track section, and the material the body is made of is strongest in compression and withstands any compressive load it could realistically experience under industry-standard design mechanical loads.

To install the gauge-plate insulator for use, it is positioned adjacent two spaced-apart rail-spacing members 8, with the tongue extending into the space between the rail-spacing members and with the left-side and right-side sections and holes positioned over the rail-spacing members and aligned with corresponding holes in the rail-spacing members. The fasteners 34 are then installed through the aligned holes in the plate and the rail-spacing members 8 to secure the gauge-plate insulator in place for use. In this way, the gauge-plate insulator mechanically couples the adjacent rail-spacing members 8 together but keeps them electrically insulated from each other, thereby mechanically interconnecting and electrically isolating the two parallel rails 8.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A gauge-plate insulator for mounting, by fasteners, between two rail-spacing members of a railroad track system, comprising:

a plate having a front end section, a rear end section, an inter-end midsection therebetween, a left side section, a right side section, a lateral midsection therebetween, and a top surface;

a tongue extending downward along the lateral midsection of the plate from the front section to the rear section of the plate;

front and rear pairs of mounting holes extending through the plate, the front pair of mounting holes positioned on the front section of the plate, the rear pair of mounting holes positioned on the rear section of the plate, left ones of the front and rear mounting holes positioned on the left section of the plate, right ones of the front and rear mounting holes positioned on the right section of the plate, and the mounting holes adapted to cooperate with the fasteners to mount the gauge-plate insulator to the rail-spacing members;

at least two ribs each extending upward from the top surface of the plate and across the plate from the left section to the right section; and at least one platform extending upward from the plate, surrounding both of the front mounting holes or both of the rear mounting holes, and defining a top surface that is positioned above the top surface of the plate;

wherein in use the gauge-plate insulator mechanically interconnects but electrically insulates the two rail-spacing members.

2. The gauge-plate insulator of claim 1, wherein the plate, the tongue, the front and rear mounting-hole pairs, and the at least one platform are all provided in a one-piece solid body.

3. The gauge-plate insulator of claim 2, wherein the one-piece solid body is made of a polyester, fiberglass-reinforced, sheet-molding or bulk-molding compound.

4. The gauge-plate insulator of claim 1, wherein the at least two ribs are each positioned generally perpendicularly to the tongue.

5. The gauge-plate insulator of claim 4, wherein the at least two ribs comprise a front rib positioned across the front section of the plate and a rear rib positioned across the rear section of the plate.

6. The gauge-plate insulator of claim 5, wherein the front rib is positioned at a front edge of the front end section of the plate and the rear rib is positioned at a rear edge of the rear end section of the plate.

7. The gauge-plate insulator of claim 5, wherein the front and rear ribs form continuous elevated front and rear elements, respectively, with the front and rear platforms, respectively.

8. The gauge-plate insulator of claim 5, wherein the at least two ribs further comprise a center rib positioned across the inter-end midsection section between the front and rear platforms.

9. The gauge-plate insulator of claim 8, wherein the center rib is positioned between the front mounting holes and the rear mounting holes.

10. A railroad track system, comprising a plurality of the gauge-plate insulators of claim 1, a series of pairs of the rail-spacing members of claim 1, and a series of parallel rails, wherein the rail-spacing members extend between and generally transverse to the parallel rails to maintain a uniform spacing of the rails, and wherein the gauge-plate insulators are mounted between the pairs of rail-spacing members to mechanically interconnect but electrically insulate the pairs of rail-spacing members.

11. A gauge-plate insulator for mounting, by fasteners, between two rail-spacing members of a railroad track system, comprising:

a plate having a front end section, a rear end section, an inter-end midsection therebetween, a left side section, a right side section, a lateral midsection therebetween, and a top surface;

a tongue extending downward along the lateral midsection of the plate from the front section to the rear section of the plate;

front and rear pairs of mounting holes extending through the plate, the front pair of mounting holes positioned on the front section of the plate, the rear pair of mounting holes positioned on the rear section of the plate, left ones of the front and rear mounting holes positioned on the left section of the plate, right ones of the front and rear mounting holes positioned on the right section of the plate, and the mounting holes adapted to cooperate with the fasteners to mount the gauge-plate insulator to the rail-spacing members; and at least two ribs each extending upward from the top surface of the plate and across the plate from the left section to the right section, wherein the at least two ribs are each positioned generally perpendicularly to the tongue, wherein in use the gauge-plate insulator mechanically interconnects but electrically insulates the two rail-spacing members.

12. The gauge-plate insulator of claim 11, wherein the plate, the tongue, the front and rear mounting-hole pairs, and the ribs are all provided in a one-piece solid body.

13. The gauge-plate insulator of claim 12, wherein the one-piece solid body is made of a polyester, fiberglass-reinforced, sheet-molding or bulk-molding compound.

14. The gauge-plate insulator of claim 11, wherein the at least two ribs comprise a front rib positioned across the front section of the plate and a rear rib positioned across the rear section of the plate.

15. The gauge-plate insulator of claim 14, wherein the front rib is positioned at a front edge of the front end section of the plate and the rear rib is positioned at a rear edge of the rear end section of the plate.

16. The gauge-plate insulator of claim 14, wherein the front and rear ribs form continuous elevated front and rear elements, respectively, with the front and rear platforms, respectively.

17. The gauge-plate insulator of claim 14, wherein the at least two ribs further comprise a center rib positioned across the inter-end midsection section between the front and rear platforms.

18. The gauge-plate insulator of claim 17, wherein the center rib is positioned between the front mounting holes and the rear mounting holes.

19. A railroad track system, comprising a plurality of the gauge-plate insulators of claim 11, a series of pairs of the rail-spacing members of claim 11, and a series of parallel rails, wherein the rail-spacing members extend between and generally transverse to the parallel rails to maintain a uniform spacing of the rails, and wherein the gauge-plate insulators are mounted between the pairs of rail-spacing members to mechanically interconnect but electrically insulate the pairs of rail-spacing members.

20. A gauge-plate insulator for mounting, by fasteners, between two rail-spacing members of a railroad track system, comprising:

a plate having a front end section, a rear end section, an inter-end midsection therebetween, a left side section, a right side section, a lateral midsection therebetween, and a top surface;

a tongue extending downward along the lateral midsection of the plate from the front section to the rear section of the plate;

front and rear pairs of mounting holes extending through the plate, the front pair of mounting holes positioned on the front section of the plate, the rear pair of mounting holes positioned on the rear section of the plate left ones of the front and rear mounting holes positioned on the left section of the plate, right ones of the front and rear mounting holes positioned on the right section of the plate, and the mounting holes adapted to cooperate with the fasteners to mount the gauge-plate insulator to the rail-spacing members; and at least one platform extending upward from the plate, surrounding both of the front mounting holes or both of the rear mounting holes, and defining a top surface that is positioned above the top surface of the plate, wherein the at least one platform is elongated and arranged generally perpendicularly to the tongue;

wherein in use the gauge-plate insulator mechanically interconnects but electrically insulates the two rail-spacing members.

21. A gauge-plate insulator for mounting, by fasteners, between two rail-spacing members of a railroad track system, comprising:

a plate having a front end section, a rear end section, an inter-end midsection therebetween, a left side section, a right side section, a lateral midsection therebetween, and a top surface;

a tongue extending downward along the lateral midsection of the plate from the front section to the rear section of the plate;

front and rear pairs of mounting holes extending through the plate, the front pair of mounting holes positioned on the front section of the plate, the rear pair of mounting holes positioned on the rear section of the plate, left ones of the front and rear mounting holes positioned on the left section of the plate, right ones of the front and rear mounting holes positioned on the right section of the plate, and the mounting holes adapted to cooperate with the fasteners to mount the gauge-plate insulator to the rail-spacing members; and at least one rib extending upward from the top surface of the plate and across the plate from the left section to the right section, wherein the at least one rib is positioned generally perpendicularly to the tongue, wherein in use the gauge-plate insulator mechanically interconnects but electrically insulates the two rail-spacing members.

* * * * *